US012649084B2

(12) United States Patent
Jia

(10) Patent No.: US 12,649,084 B2
(45) Date of Patent: Jun. 9, 2026

(54) FOLDING TREADMILL

(71) Applicant: Zhejiang Maizhong Health Technology Co., Ltd., Jinhua (CN)

(72) Inventor: Ruitao Jia, Jinhua (CN)

( * ) Notice: Subject to any disclaimer, the term of this patent is extended or adjusted under 35 U.S.C. 154(b) by 58 days.

(21) Appl. No.: 18/734,394

(22) Filed: Jun. 5, 2024

(65) Prior Publication Data

US 2024/0408443 A1 Dec. 12, 2024

(30) Foreign Application Priority Data

Jun. 7, 2023 (CN) ..... 202310672716.5

(51) Int. Cl.
*A63B 22/02* (2006.01)

(52) U.S. Cl.
CPC ..... *A63B 22/02* (2013.01); *A63B 2210/50* (2013.01)

(58) Field of Classification Search
CPC . A63B 22/02; A63B 2210/50; A63B 2210/58; A63B 2225/09; A63B 2225/093
See application file for complete search history.

(56) References Cited

U.S. PATENT DOCUMENTS 5,460,586 A * 10/1995 Wilkinson ..... A63B 21/4047 482/54
5,711,745 A * 1/1998 Yang ..... A63B 22/02 482/54
7,780,578 B2 * 8/2010 Packham ..... A63B 22/02 482/4
7,789,807 B1 * 9/2010 Wang ..... A63B 22/0235 482/52
8,926,479 B2 * 1/2015 Chen ..... A63B 22/02 292/137
10,589,147 B1 * 3/2020 Kostadis ..... A63B 22/025
11,027,169 B2 * 6/2021 Xing ..... A63B 22/0046
11,285,361 B1 * 3/2022 Kostadis ..... A63B 22/02
11,406,865 B2 * 8/2022 Jin ..... A63B 22/0235
11,607,598 B2 * 3/2023 Luo ..... A63B 71/0036
12,023,544 B2 * 7/2024 Hu ..... A63B 21/4035
12,233,310 B2 * 2/2025 Xu ..... A63B 22/02
2004/0198558 A1 * 10/2004 Chang ..... A63B 22/02 482/54
2006/0122038 A1 * 6/2006 Chou Lin ..... A63B 22/0235 482/54
2008/0234111 A1 * 9/2008 Packham ..... A63B 22/02 482/54

(Continued)

*Primary Examiner* — Joshua Lee

(57) ABSTRACT

A folding treadmill comprises a running platform, two columns and detachable rotating assemblies; the running platform comprises multiple sub-running platforms that are hinged in sequence; the two columns are arranged on both sides of the running platform; the detachable rotating assemblies are used for dismantling and/or rotationally connecting the running platform and the columns. The roller assemblies facilitate the movement of the treadmill, making it easy to transport; the columns and the running platform can be folded through the detachable rotating assemblies, or the columns and the running platform can be separated through the detachable rotating assemblies, making it convenient for transportation and reducing the risk of damage during transportation, facilitating the replacement of components; the running platform can be easily folded and transported through the design of three sub-running platforms, taking up less space.

5 Claims, 5 Drawing Sheets

(56) References Cited

U.S. PATENT DOCUMENTS

| | | | | |
|---|---|---|---|---|
| 2008/0280734 | A1* | 11/2008 | Dickie | A63B 22/0023 482/54 |
| 2011/0021323 | A1* | 1/2011 | Wu | A63B 22/0235 482/54 |
| 2015/0051051 | A1* | 2/2015 | Liu | A63B 22/02 482/54 |
| 2023/0136863 | A1* | 5/2023 | Luo | A63B 21/023 482/54 |
| 2025/0195943 | A1* | 6/2025 | Luo | A63B 71/0054 |

* cited by examiner

FOLDING TREADMILL

1. TECHNICAL FIELD

The invention relates to the technical field of treadmills, in particular to a folding treadmill.

2. BACKGROUND ART

Running is one of the most common forms of exercise and fitness, and it is widely popular. With the advancement of technology, treadmills have become increasingly popular, allowing users to experience the joy of running without having to leave their homes. However, existing treadmills are difficult to dismantle, assemble, and transport due to their numerous complex components and large size. This results in the need for more space for storage and inconvenience in moving them; furthermore, most existing treadmills have an integrated design, making it inconvenient to dismantle and separate the handrail columns from the treadmill or replace components. Based on these problems, a folding treadmill has been designed.

3. SUMMARY OF THE INVENTION

To overcome at least one of the drawbacks mentioned in the prior art, the invention provides a folding treadmill. The roller assemblies facilitate the movement of the treadmill, making it easy to transport; the columns and the running platform can be folded or separated through the detachable rotating assemblies, making it convenient for transportation and reducing the risk of damage during transportation, facilitating the replacement of components; the running platform can be easily folded and transported through the design of three sub-running platforms, taking up less space.

The technical scheme adopted by the invention to solve the problem is as follow:

- a folding treadmill comprises a running platform, the running platform comprises multiple sub-running platforms that are hinged in sequence; two columns, the two columns are arranged on both sides of the running platform; detachable rotating assemblies, the detachable rotating assemblies are used for dismantling and/or rotationally connecting the running platform and the columns.

By adopting the above scheme, multiple successively hinged sub-running platforms can be folded, so that the space occupancy rate can be greatly reduced, this allows for transporting more treadmills on the same area of land during transportation; moreover, the columns and the running platform can be folded through the detachable rotating assemblies, making it convenient for transportation and storage, the columns and the running platform can also be separated, facilitating the replacement of components, reducing the risk of damage during transportation.

Further, the detachable rotating assembly comprises a knob, a fixed plate, a connecting plate, a telescopic rod, a pressure plate and a spring, one end of the telescopic rod is fixedly connected to the connecting plate, the other end of the telescopic rod penetrates the pressure plate, the fixed plate and is fixedly connected to the knob, the spring is sleeved on the outside of the telescopic rod between the connecting plate and the fixed plate.

By adopting the above scheme, the rotary connection and disassembly effects can be achieved through the detachable rotating assemblies.

Further, tracks are arranged at the corresponding positions between both sidewalls of the running platform and the detachable rotating assemblies, the track comprises arc segments and rectangular segments, the connecting plate, at least part of the telescopic rod and the pressure plate pass through the arc segment and/or the rectangular segment, the connecting plate extends into the running platform and is rotationally connected.

By adopting the above scheme, the connecting plate extends into the interior of the running platform and is rotationally connected, so that the running platform and the columns can be folded easily by rotating the knob; additionally, by pulling the knob, the spring is compressed, so that the connecting plate is separated from the running platform; then, rotating the knob to take out the connecting plate and the pressure plate from the rectangular segment and/or the arc segment, achieving the disassembly of the columns and the running platform.

Further, in the unfolded state of the columns, the angle between the column and the running platform is 90°; in the folded state of the columns, the columns and the running platform are horizontally arranged.

By adopting the above scheme, the columns are folded for easy storage, which solves the problem of the columns taking up a lot of space in the storage of them; they will be vertical when used, making them easy to use.

Further, the number of the sub-running platforms is three, when the three sub-running platforms are unfolded, the three sub-running platforms are arranged horizontally; when the three sub-running platforms are folded, the three sub-running platforms are arranged longitudinally.

By adopting the above scheme, the sub-running platforms can be folded into three layers, which take up less horizontal space, facilitate transportation and home storage, and improve the storage effect of the treadmill.

Further, roller assemblies are arranged at the bottom of the sub-runway near the side of the columns, the roller assembly comprises a roller and a locking structure for locking the roller.

By adopting the above scheme, the folded treadmill can be conveniently transported through the rollers with the locking structure, and the rollers can be locked with the locking structure to facilitate the use of the treadmill and prevent it from rolling.

4. BRIEF DESCRIPTION OF ACCOMPANY DRAWINGS

Attached Dings Marks: 1 running platform; 11 sub-running platform; 2 column; 3 detachable rotating assembly; 31 knob; 32 fixed plate; 33 connecting plate; 34 telescopic rod; 35 pressure plate; 36 spring; 4 track; 41 arc segment; 42 rectangular segment; 5 roller assembly; 51 roller; 52 locking structure.

5. SPECIFIC EMBODIMENT OF THE INVENTION

For better understanding and implementation, the technical schemes in the embodiments of the invention will be clearly and completely described in combination with the accompanying drawings in the embodiments of the invention. Obviously, the described embodiments are only some of the embodiments of the invention, but not all of the embodiments. Based on the embodiments in this invention, all other embodiments obtained by those of ordinary skill in the art without making creative efforts shall fall within the protection scope of this invention.

In order to facilitate understanding of the embodiments of the invention, specific embodiments will be further explained below in combination with the accompanying drawings, and each embodiment does not constitute a limitation to the embodiments of the invention.

In the description of the invention, it should be understood that the orientation or positional relationship indicated by the terms "upper", "lower", "front", "back", "left", "right", "vertical", "horizontal", "top", "bottom", "inner", "outer" and so on are based on the orientation or positional relationship shown in the accompanying drawings, only for the convenience of describing the invention and simplifying the description, rather than indicating or implying that the indicated device or element must have a specific orientation, as well as a specific orientation structure and operation, therefore, it should not be construed as a limitation of the invention.

Unless otherwise defined, all technical and scientific terms used herein have the same meaning as commonly understood by those of ordinary skill in the technical field to which the invention belongs. The terminology used herein in the specification of the invention is for the object of describing specific embodiments only and is not intended to limit the invention.

Figure 1:
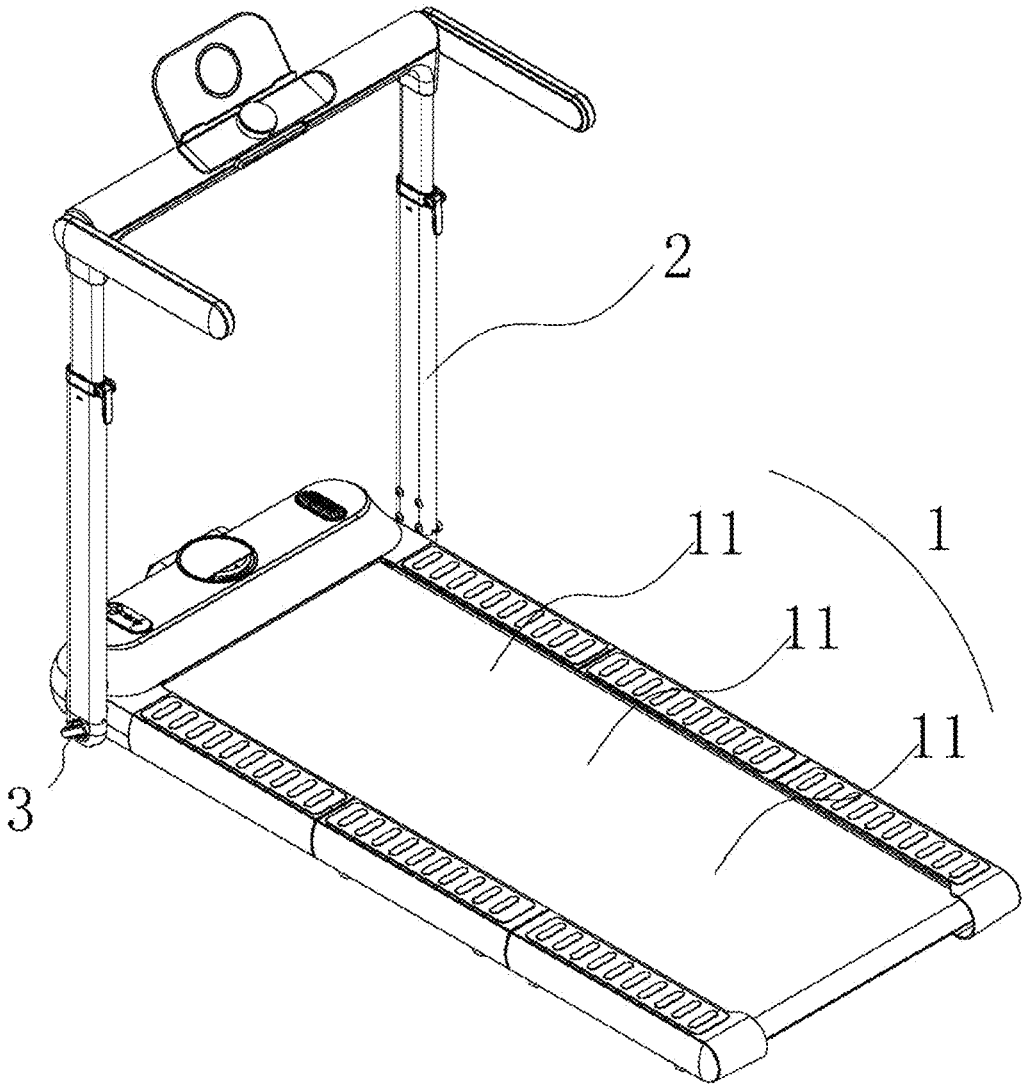
FIG. 1 is a schematic diagram of the unfolded state of the embodiment of the invention.
Figure 2:
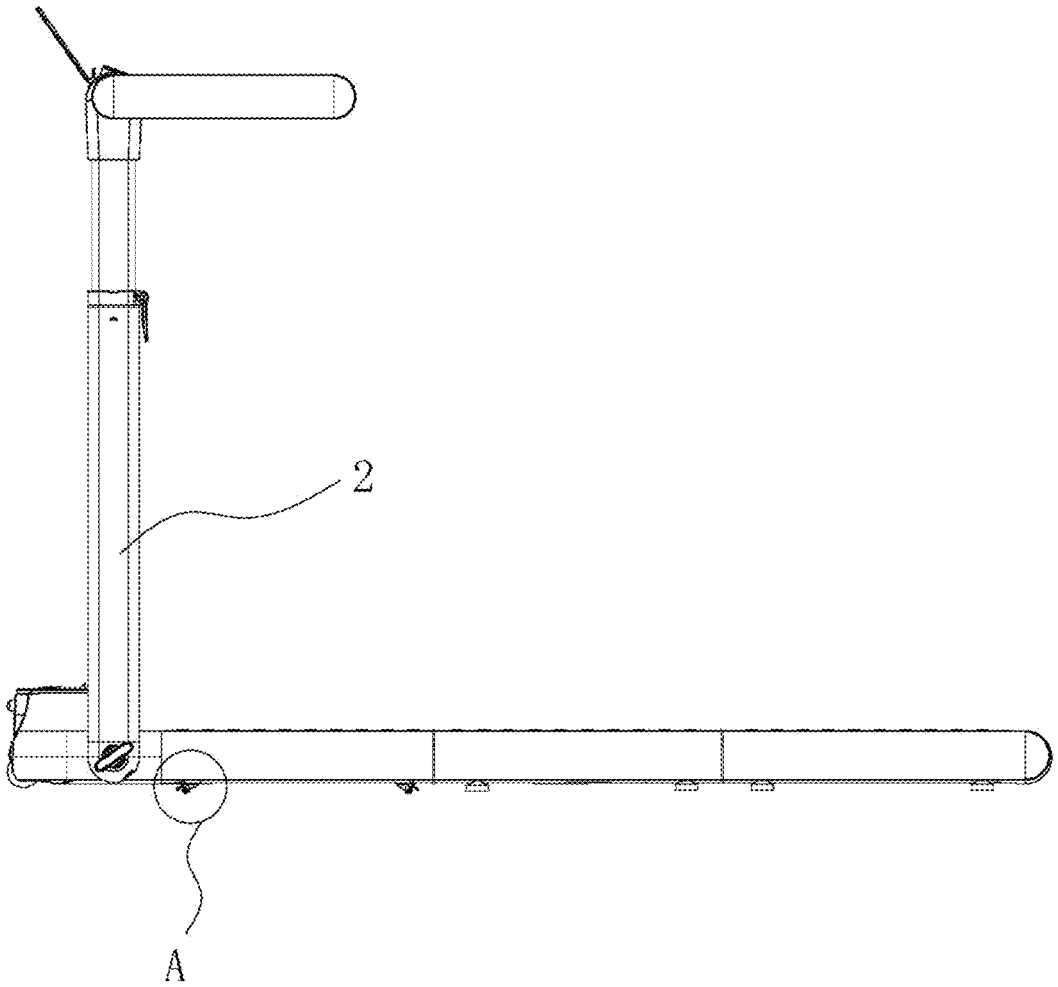
FIG. 2 is a plan view of the embodiment of the invention.
Figure 3:
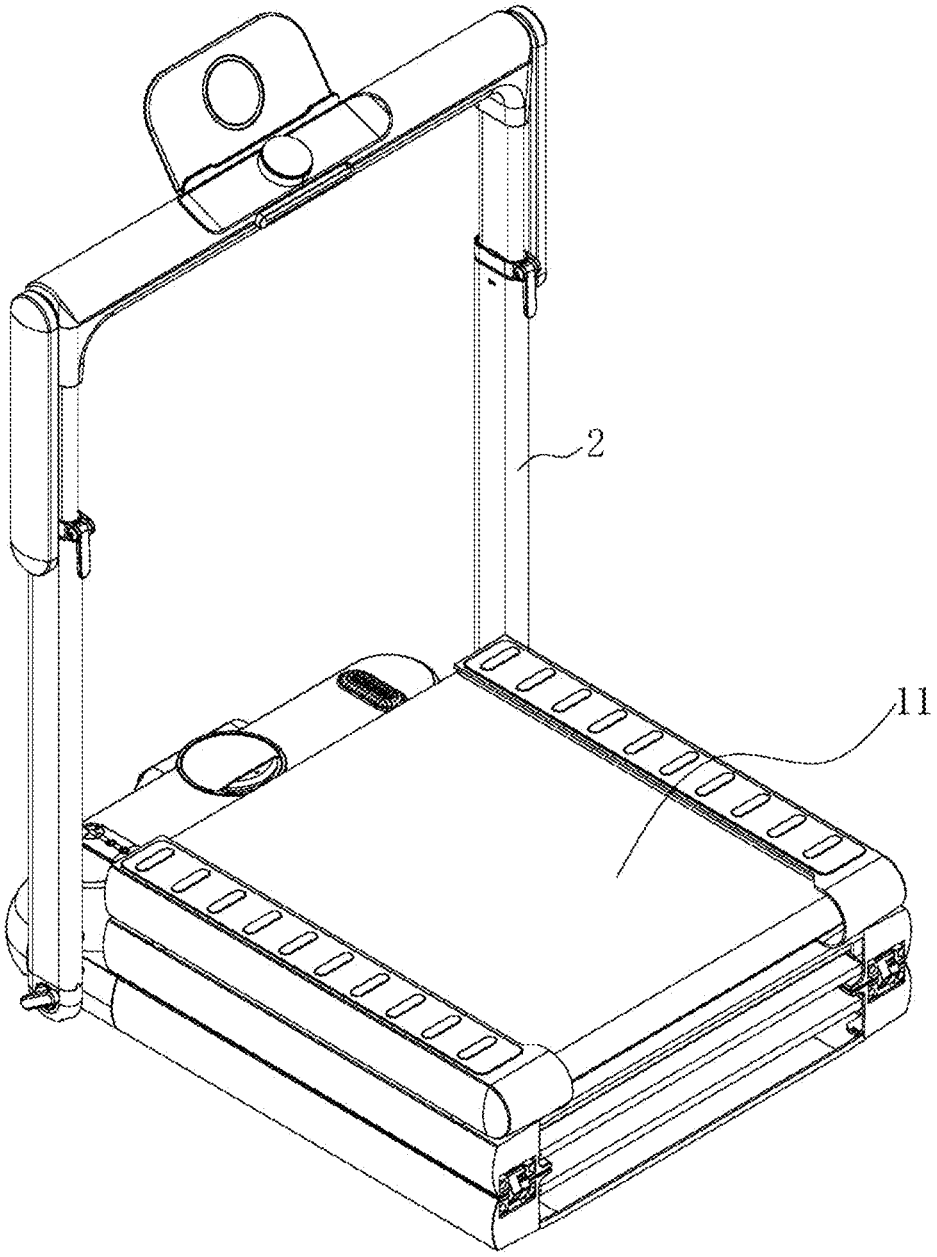
FIG. 3 is a schematic diagram of the folded state of the embodiment of the invention.
Figure 4:
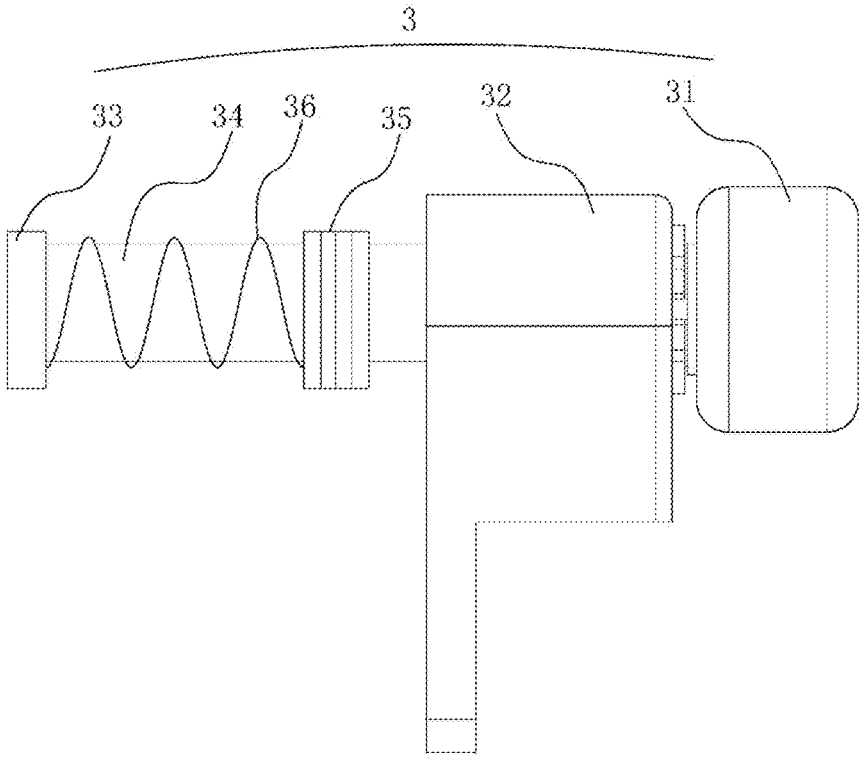
FIG. 4 is a schematic diagram of the detachable rotating assembly of the embodiment of the invention.
Figure 5:
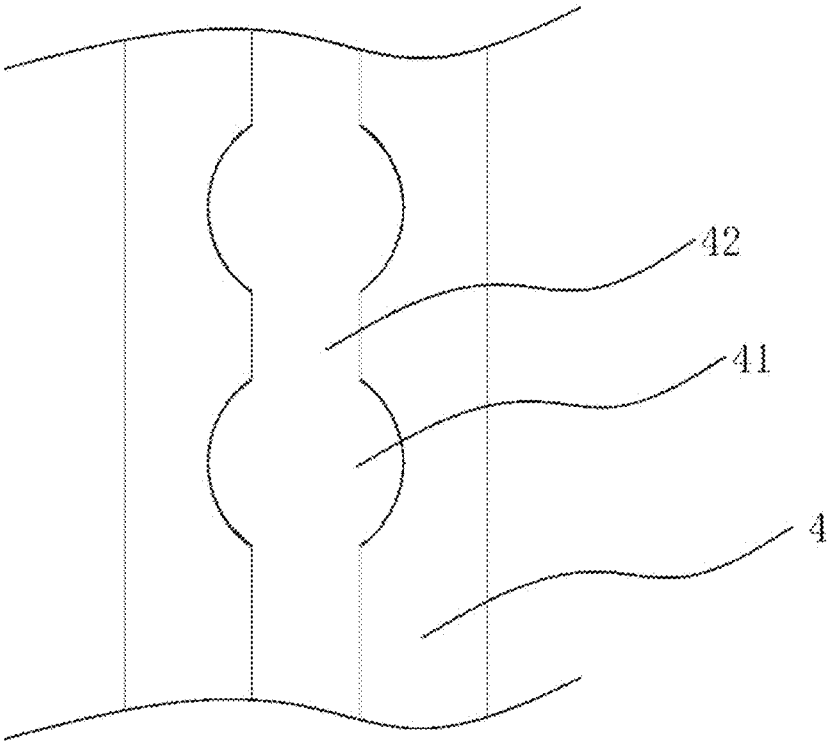
FIG. 5 is a plan view of the track of the embodiment of the invention.
Figure 6:
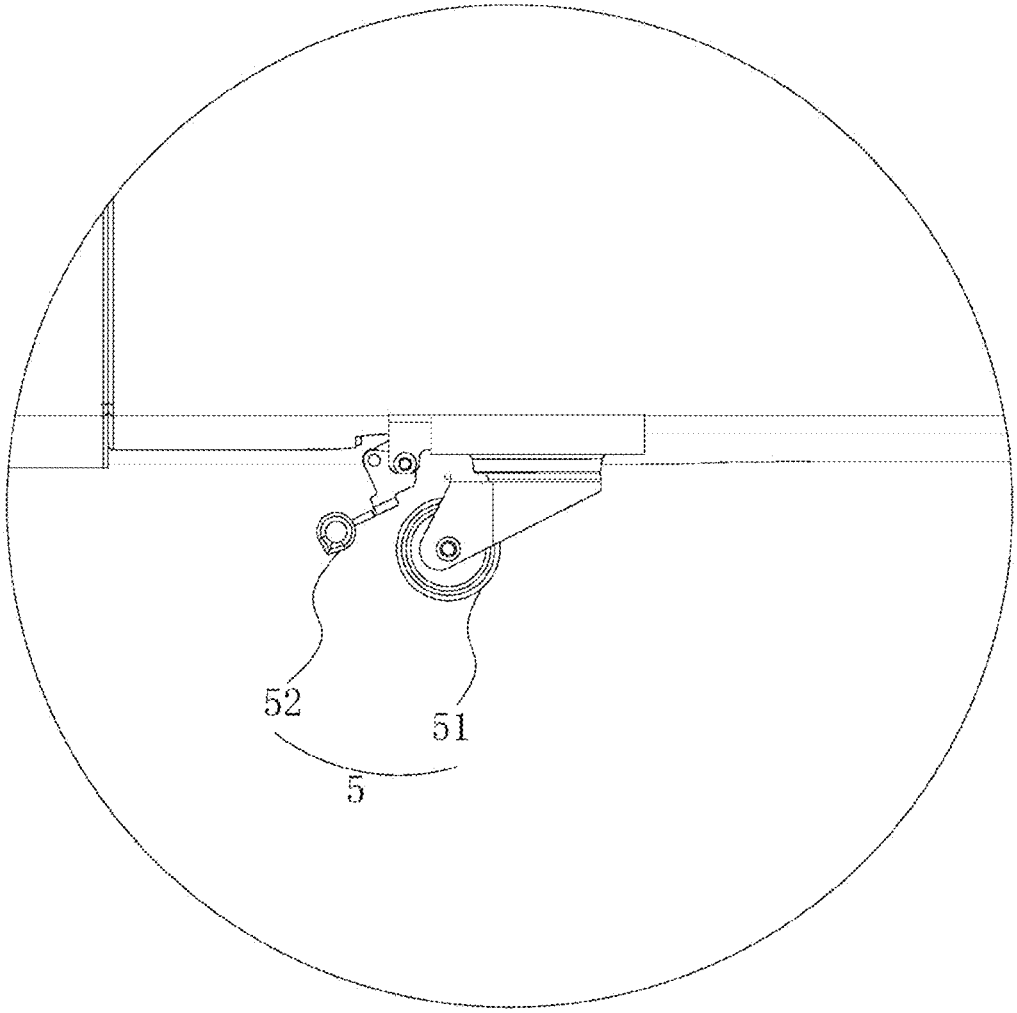
FIG. 6 is an enlarged schematic diagram of point A in FIG. 2.

Please refer to FIG. 1-6, the invention provides a folding treadmill comprises a running platform 1, columns 2, and detachable rotating assemblies 3, the running platform 1 comprises multiple sub-running platforms 11 that are hinged in sequence; the number of the columns 2 is two, the two columns 2 are arranged on both sides of the running platform 1; the detachable rotating assemblies 3 are used for dismantling and/or rotationally connecting the running platform 1 and the columns 2. Multiple successively hinged sub-running platforms 11 can be folded, so that the space occupancy rate can be greatly reduced, this allows for transporting more treadmills on the same area of land during transportation; moreover, the columns 2 and the running platform 1 can be folded through the detachable rotating assemblies, making it convenient for transportation and storage, the columns 2 and the running platform 1 can also be separated, facilitating the replacement of components, reducing the risk of damage during transportation.

In this embodiment, the number of the sub-running platforms 11 is three, when the three sub-running platforms 11 are unfolded, the three sub-running platforms 11 are arranged horizontally, it can also be said that the three sub-running platforms 11 are located on the same plane, allowing users to exercise on the running platform 1; when the three sub-running platforms 11 are folded, the three sub-running platforms are arranged longitudinally, specifically, the bottom surface of the sub-running platform 11 located at one end fits with the bottom surface of the sub-running platform 11 located in the center, and the top surface of the sub-running platform 11 located in the center fits with the top surface of the sub-running platform 11 located at the other end, this design allows the overall size of the treadmill to be reduced through folding; the sub-running platforms 11 can be folded into three layers, which take up less horizontal space, facilitate transportation and home storage, and improve the storage effect of the treadmill.

The detachable rotating assembly 3 comprises a knob 31, a fixed plate 32, a connecting plate 33, a telescopic rod 34, a pressure plate 35 and a spring 36, one end of the telescopic rod 34 is fixedly connected to the connecting plate 33, the other end of the telescopic rod 34 penetrates the pressure plate 35, the fixed plate 32 and is fixedly connected to the knob 31, the spring 36 is sleeved on the outside of the telescopic rod 34 between the connecting plate 33 and the fixed plate 32, the rotary connection and disassembly effects can be achieved through the detachable rotating assemblies 3. Tracks 4 are arranged at the corresponding positions between both sidewalls of the running platform 1 and the detachable rotating assemblies 3, the track 4 comprises arc segments 41 and rectangular segments 42, the connecting plate 33, at least part of the telescopic rod 34 and the pressure plate 35 pass through the arc segment 41 and/or the rectangular segment 42, the connecting plate 33 extends into the running platform 1 and is rotationally connected.

In this embodiment, the connecting plate 33 extends into the interior of the running platform 1 and is rotationally connected, so that the running platform 1 and the columns 2 can be folded easily by rotating the knob 31; additionally, by pulling the knob 31, the spring 36 is compressed, so that the connecting plate 33 is separated from the running platform 1; then, rotating the knob 31 to take out the connecting plate 33 and the pressure plate 35 from the rectangular segment 42 and/or the arc segment 41, achieving the disassembly of the columns 2 and the running platform 1.

In the unfolded state of the columns 2, the angle between the column 2 and the running platform 1 is 90°; in the folded state of the columns 2, the columns 2 and the running platform 1 are horizontally arranged. The columns 2 are folded for easy storage, which solves the problem of the columns 2 taking up a lot of space in the storage of them; they will be vertical when used, making them easy to use.

In this embodiment, roller assemblies 5 are arranged at the bottom of the sub-runway 11 near the side of the columns 2, the roller assembly 5 comprises a roller 51 and a locking structure 52 for locking the roller 51. The folded treadmill can be conveniently transported through the rollers 51 with the locking structure 52, and the rollers 51 can be locked with the locking structure 52 to facilitate the use of the treadmill and prevent it from rolling; in other embodiments, the bottoms of the other two sub-running platforms 11 can also be provided with feet, and the feet are at the same level as the bottom of the rollers 51, which can improve the support stability during use.

The working principle and steps of the invention are as follow: when it is necessary to fold, the sub-running platforms 11 are folded in sequence, and then the columns 2 are folded; when it is necessary to disassemble, the knob 31 is pulled, the spring 36 is compressed, so that the connecting plate 33 is separated from the running platform 1; then, the knob 31 is rotated to take out the connecting plate 33 and the pressure plate 35 from the rectangular segment 42 and/or the arc segment 41; it can be disassembled at this time, which is simple to operate and has good practicality.

The technical means provided in the scheme of the invention are not limited to the technical means provided in the above embodiments, but also include technical schemes composed of any combination of the above technical features. It should be noted that for those of ordinary skill in the art, several improvements and modifications can be made without departing from the principles of the invention, and these improvements and modifications are also regarded as the protection scope of the invention.

The invention claimed is:

1. A folding treadmill, comprising:

a running platform, the running platform comprising multiple sub-running platforms that are hinged in sequence;

two columns, the two columns arranged on both sides of the running platform; and detachable rotating assemblies, the detachable rotating assemblies used for dismantling and/or rotationally connecting the running platform and the columns;

wherein the detachable rotating assembly comprises a knob, a fixed plate, a connecting plate, a telescopic rod, a pressure plate and a spring, one end of the telescopic rod is fixedly connected to the connecting plate, the other end of the telescopic rod penetrates the pressure plate and the fixed plate and is fixedly connected to the knob, and the spring is sleeved on the outside of the telescopic rod between the connecting plate and the fixed plate.

2. The folding treadmill of claim 1, wherein tracks are arranged at the corresponding positions between both sides of the running platform and the detachable rotating assemblies, each track comprises arc segments and rectangular segments; wherein, the connecting plate, at least part of the telescopic rod, and the pressure plate pass through the arc segments and/or the rectangular segments, the connecting plate extends into the running platform.

3. The folding treadmill of claim 1, wherein, in an unfolded state of the columns, an angle between the columns and the running platform is 90°; wherein, in a folded state of the columns, the columns and the running platform are horizontally arranged.

4. The folding treadmill of claim 1, wherein, the number of the sub-running platforms is three; wherein, when the three sub-running platforms are unfolded, the three sub-running platforms are arranged horizontally; wherein, when the three sub-running platforms are folded, the three sub-running platforms are arranged vertically.

5. The folding treadmill of claim 1, wherein roller assemblies are arranged at a bottom of a sub-runway near a side of the columns, wherein each roller assembly comprises a roller and a locking structure for locking the roller.

* * * * *